United States Patent [19]

Gömann et al.

[11] Patent Number: 4,585,386

[45] Date of Patent: Apr. 29, 1986

[54] APPARATUS FOR TRANSPORTING AND CHANGING THE ORIENTATION OF CIGARETTES OR THE LIKE

[75] Inventors: Rolf Gömann, Dassendorf; Hans-Jochen Grasse, Wentorf, both of Fed. Rep. of Germany

[73] Assignee: Hauni-Werke Körber & Co. KG., Hamburg, Fed. Rep. of Germany

[21] Appl. No.: 773,506

[22] Filed: Sep. 4, 1985

Related U.S. Application Data

[63] Continuation of Ser. No. 413,665, Sep. 1, 1982, abandoned.

[30] Foreign Application Priority Data

Jan. 14, 1982 [DE] Fed. Rep. of Germany ..... 3200886

[51] Int. Cl.[4] ..... A24C 5/35

[52] U.S. Cl. ..... 414/403; 198/347; 198/465.1; 198/951

[58] Field of Search ..... 414/303, 403, 404, 419, 414/413, 222; 198/347, 951, 465.1, 465.2, 803.01

[56] References Cited

U.S. PATENT DOCUMENTS

| | | | |
|---|---|---|---|
| 3,777,911 | 12/1973 | Bornfleth | 414/222 |
| 4,207,720 | 6/1980 | Tolasch et al. | 53/151 |
| 4,241,822 | 12/1980 | Molins et al. | 198/951 X |
| 4,278,385 | 7/1981 | Bardenhagen et al. | 414/419 |
| 4,338,057 | 7/1982 | Molins | 414/413 X |

FOREIGN PATENT DOCUMENTS

| | | | |
|---|---|---|---|
| 1292069 | 5/1963 | Fed. Rep. of Germany | 198/347 |
| 2747491 | 4/1979 | Fed. Rep. of Germany | 198/347 |
| 2024758 | 1/1980 | United Kingdom . | |
| 2072119 | 9/1981 | United Kingdom | 414/403 |
| 2097352 | 11/1982 | United Kingdom | 198/347 |

*Primary Examiner*—Joseph E. Valenza
*Assistant Examiner*—David A. Bucci
*Attorney, Agent, or Firm*—Peter K. Kontler

[57] ABSTRACT

An automatic apparatus which transports filter cigarettes from a tipping machine to a packing machine has a first transporting unit which directly couples the output of the tipping machine with the magazine of the packing machine, and a second transporting unit which receives the surplus of filter cigarettes from a diverting device of the first transporting unit when the output of the tipping machine exceeds the requirements of the packing machine and delivers the removed surplus back to the first transporting unit when the requirements of the packing machine exceed the output of the tipping machine. The second transporting unit employs a tray filler which receives cigarettes from the diverting device, a first conveying section which transports filled trays away from the tray filler, a tray evacuator which converts the contents of successive filled trays into a stream of cigarettes and turns the cigarettes through 180° so that the orientation of cigarettes in the stream deviates from the orientation of cigarettes in the first transporting unit, and a second conveying section which delivers the stream to a junction of the first transporting unit. In order to restore the original orientation of diverted cigarettes, the first or second conveying section embodies a loop-shaped inverting device which changes the orientation of cigarettes in filled trays or the orientation of cigarettes in the stream by 180° so that the orientation of cigarettes which reenter the first transporting unit is the same as that of non-diverted cigarettes.

49 Claims, 6 Drawing Figures

38
42
61
39
37
221
51
52
49
34
36
46
44
12
VI
49
47
VI
58
41
222

41
34
46
44
43
47
12a
53
51
48
52
49
12
56
59
12b

34'
54
55
57
58
42

APPARATUS FOR TRANSPORTING AND CHANGING THE ORIENTATION OF CIGARETTES OR THE LIKE

This application is a continuation of application Ser. No. 413,665, filed Sept. 1, 1982, now abandoned.

BACKGROUND OF THE INVENTION

The present invention relates to apparatus for transporting rod-shaped articles, especially rod-shaped articles (such as plain or filter cigarettes, cigars, cigarillos or filter rod sections) which constitute or form part of smokers' products. More particularly, the invention relates to improvements in apparatus for transporting rod-shaped articles by resort to a transporting unit which has at least one article diverting portion and at least one junction serving to receive articles from a source other than the main source of supply. Still more particularly, the invention relates to improvements in transporting apparatus of the type wherein the diverting portion of the just discussed (first) transporting unit is connected with the junction by a second transporting unit having a tray filler which receives articles from the diverting portion of the first transporting unit and a tray evacuator which receives filled trays from the tray filler and converts the contents of filled trays into a stream of rod-shaped articles which are admitted to the junction of the first transporting unit. In such apparatus, the second transporting unit normally further comprises a first conveying section which delivers filled trays from the tray filler to the tray evacuator and a second conveying section which serves to deliver the stream of articles from the tray evacuator to the junction.

Rod-shaped articles of the tobacco processing industry embrace a variety of articles which do not consist of mirror symmetrical halves. Typical examples of such articles are filter cigarettes, cigarillos or cigars wherein the filter is disposed at one end and the remaining portion of the article constitutes a wrapped tobacco filler. Furthermore, such articles also include plain cigarettes wherein the imprint (denoting the name and/or the trademark of the manufacturer) is disposed nearer to the one than to the other axial end thereof. Prior to introducing such "unsymmetrical" rod-shaped articles into packs, boxes or other types of receptacles in which the articles are offered for sale to smokers, it is necessary to ensure that the orientation of all articles is the same, e.g., that the filters of filter cigarettes, cigars or cigarillos face in the same direction. This is the customary way of introducing such articles into packs or the like. It can be readily ascertained that, on opening of a pack of filter cigarettes, the filter plugs of all cigarettes in the pack are adjacent to the open end so that the cigarettes can be removed individually or in groups by engaging their filter plugs rather than the tobacco-containing portions of such commodities.

Direct coupling of making and processing machines or first and second processing machines is gaining in popularity in a number of industries, especially in the tobacco industry. Thus, it is now quite customary to directly connect a cigarette maker with one inlet of a filter tipping machine, to directly couple another inlet of the filter tipping machine with the maker of filter rod sections, and to directly couple the outlet of the filter tipping machine with a packing machine so that the production line including such machines makes the plain cigarettes and the filter rod sections, assembles plain cigarettes and filter rod sections into filter cigarettes of unit length, and introduces filter cigarettes into packs which are sealed, provided with transparent wrappers of cellophane or the like, and introduced into cartons which are thereupon inserted into boxes or cartons ready for storage or for immediate shipment to wholesalers or retailers. The connections between the machines of a complete production line normally constitute transporting units which are capable of advancing multi-layer streams of rod-shaped articles in such a way that the articles advance in a direction at right angles to their axes (i.e., sideways). The main or first transporting unit between two successive machines is normally combined with a second or auxiliary transporting unit which constitutes a reservoir or magazine and takes care of fluctuations in the output of the preceding machine and of fluctuations in the requirements of the next-following machine. For example, the second transporting unit between a filter tipping machine and a packing machine can comprise a tray filler which accepts the surplus of the output of the filter tipping machine when such output exceeds the requirements of the packing machine. The second transporting unit further comprises a tray evacuator which receives filled trays from the tray filler and converts the contents of trays into a stream of articles which are returned to the first transporting unit when the output of the filter tipping machine does not match the requirements of the packing machine.

An apparatus of the just outlined character is disclosed, for example, in German Offenlegungsschrift No. 30 13 014. The tray filler is directly coupled with the tray evacuator by a conveying section wherein the filled trays advance into the range of the tray evacuator. This is desirable and advantageous because the diversion of surplus articles from the first transporting unit into the tray filler, the filling of empty trays, the transport of the thus obtained filled trays from the tray filler to the tray evacuator, and the conversion of the contents of filled trays into a stream of rod-shaped articles can be effected automatically. However, the last stage of the transport of temporary surplus back into the first transporting unit presents problems because, as a rule, a tray evacuator changes the orientation of articles which are removed from filled trays and converted into a stream of parallel articles which are ready to move sideways. In connection with the treatment of filter cigarettes, this means that the orientation of filter cigarettes which have been diverted from the first transporting unit (to be fed into trays, transported with trays and converted into a stream of articles) is changed by 180° so that they cannot be automatically returned into the first transporting unit since the latter would then contain cigarettes having a first orientation (namely, the orientation imposed upon them by the filter tipping machine which discharges the articles into the first transporting unit) as well as cigarettes having a second orientation (namely, the orientation imposed by the tray evacuator). Therefore, the apparatus of the German publication is not suitable for fully automatic operation and has failed to gain widespread acceptance in the tobacco processing industry. If such apparatus is used between a filter tipping machine and a packing machine, filled trays are supplied to its tray evacuator by hand so that the articles which are evacuated from filled trays and converted into a multi-layer or single-layer stream have the same orientation as the articles in the first transporting unit, i.e., the stream which is formed by the tray evacuator, can be admitted directly into the first transporting unit for advancement into the packing machine with the articles which did not leave the first transporting unit on arrival at the diverting station. Such manual feeding of filled trays to the tray evacuator is a time-consuming and cumbersome procedure which necessitates constant attendance by one or more workmen and the establishment of an adequate supply of filled trays at a location not overly remote from the tray evacuator. In fact, when filled trays are to supplement the output of a filter tipping machine which normally turns out very large quantities of articles per unit of time, the speed of the packing machine must be reduced or the packing machine must be brought to a full stop whenever the output of the filter tipping machine decreases only slightly below the normal output. This entails very high losses in output, especially in a modern production line which can turn out in excess of 7000 cigarettes per minute.

OBJECTS AND SUMMARY OF THE INVENTION

An object of the invention is to provide a novel and improved apparatus which can automatically remove the surplus of rod-shaped articles from a first transporting unit, temporarily store the removed articles, and return the stored articles to the first transporting unit in such a way that the orientation of returned articles matches the orientation of articles which do not leave the first transporting unit.

Another object of the invention is to provide very simple but efficient, rugged and relatively inexpensive means for ensuring that all articles which are removed from the first transporting unit reassume their original orientation not later than at the locus of reentry into the first transporting unit.

A further object of the invention is to provide an apparatus which treats the articles gently irrespective of the speed at which the articles are transported in its transporting units and which can be installed in existing production lines as a superior substitute for heretofore known apparatus.

An additional object of the invention is to provide a fully automated apparatus which can employ a conventional tray filler and a conventional tray evacuator, i.e., an evacuator which invariably changes the orientation of rod-shaped articles during conversion of the contents of successive filled trays into a continuous or discontinuous stream of articles which move (or are ready to move) sideways.

Still another object of the invention is to provide a novel and improved magazine or reservoir for temporary storage of rod-shaped articles in an apparatus of the above outlined character.

A further object of the invention is to provide novel and improved article conveying sections for use in the second transporting unit of the improved apparatus.

Another object of the invention is to provide a novel and improved method of manipulating cigarettes or analogous rodshaped articles of the tobacco processing industry between the locus of diversion from a path extending between a producing and a consuming machine or between a first processing machine and a second processing machine and the locus where the thus diverted articles reenter the path.

An additional object of the invention is to provide a novel and improved method and a novel and improved apparatus for manipulating filter cigarettes between a filter tipping machine and a packing machine.

An ancillary object of the invention is to provide novel and improved means for transporting filled trays in an apparatus of the above outlined character.

The invention resides in the provision of an apparatus for manipulating rod-shaped articles which constitute or form part of smokers' products. The apparatus comprises a first transporting unit which serves to advance the articles (e.g., from a maker to a processing machine or from a first to a second processing machine) in a predetermined direction and in a predetermined orientation (for example, if the articles are filter cigarettes of unit length, they are advanced at right angles to their respective axes and in such a way that all of the filters are disposed at one side of the path which is defined by the first transporting unit) and includes at least one article diverting means and at least one junction (such junction is or can be disposed downstream of the diverting means, as considered in the direction of advancement of articles in the first transporting unit), and a second transporting unit which can be said to constitute a reservoir for surplus articles and includes a tray filler arranged to admit diverted articles into empty trays and thus convert empty trays into filled trays, a tray evacuator which is arranged to remove articles from filled trays and to convert the removed articles into a stream with an attendant change in orientation of articles, a first conveying section which serves to deliver filled trays from the tray filler to the tray evacuator, a second conveying section which serves to deliver the stream of articles to the junction of the first transporting unit for advancement with the non-diverted articles, and inverting means for changing the orientation of diverted articles in addition to the change of orientation which is effected by the tray evacuator so that the combined change in orientation restores the predetermined orientation of diverted articles not later than in the junction.

The inverting means preferably includes a portion extending along an arc with reference to the first transporting unit.

In accordance with one presently preferred embodiment of the invention, the inverting means can form part of the second conveying section of the second transporting unit; in such apparatus, the aforementioned portion of the inverting means can extend along an arc of 180°. For example, the second conveying section can comprise a first portion which receives the article stream from the tray evacuator and is at least substantially parallel to the first transporting unit, an arcuate second portion which constitutes the aforementioned portion of the inverting means and receives the article stream from the first portion, and a third portion which is at least substantially parallel to the first transporting unit, which receives the article stream from the second portion, and which advances the articles of the stream toward the junction in a direction counter to the direction of advancement of articles in the first transporting unit. In such apparatus, the second conveying section of the second transporting unit further comprises a system of conveyors or other suitable means for reversing the direction of advancement of articles between the third portion of the second conveying section and the junction.

Alternatively, the aforementioned portion of the inverting means can form part of the first conveying section of the second transporting unit. In such apparatus, the portion of the inverting means can extend along an arc of 180°. In accordance with a modification, the first transporting unit, the tray filler and the tray evacuator can be disposed in a common vertical plane and the aforementioned portion of the inverting means can constitute a substantially U-shaped loop which is disposed between the tray filler and the tray evacuator. Such portion of the inverting means can include a plurality of pallets or other suitable carriers each of which can accept and advance a plurality of filled trays from the tray filler to the tray evacuator and means for advancing the carriers along an arcuate path, e.g., along a substantially semicircular path. The advancing means can comprise an elongated driven conveying element (such as an endless belt or chain) defining the arcuate path and having spaced-apart first entraining elements which are separably engageable with complementary second entraining elements provided on the carriers. The conveying element can be disposed in a substantially vertical axis so that the orientation of the carriers with reference to the vertical axis remains at least substantially unchanged.

The curve-going conveyor can comprise at least one receptacle for filled trays and means for advancing the receptacle along an arcuate path about a substantially vertical axis. In such apparatus, the advancing means can comprise an endless belt, chain or an analogous conveying element which is preferably disposed in a substantially horizontal plane and is laterally adjacent to the arcuate path. The receptacle can comprise first and second mobile components, means for moving the first component into engagement with a filled tray from above, and means for moving the second component into engagement with the same filled tray from below. The arrangement is preferably such that the first and second components of the receptacle respectively engage upper and lower corner portions of a filled tray which are disposed diagonally opposite each other. The first component can include or constitute a yoke, and the means for moving the first component can include means for pivoting the yoke between a raised position in which the yoke is disengaged from a filled tray and a lowered position in which the yoke engages the tray. The advancing means for the receptacle can comprise first and second endless flexible elements, such as link chains, which are respectively disposed in upper and lower horizontal planes; the first and second components of the receptacle are then respectively secured to the first and second flexible elements, preferably to the links of the aforementioned chains. Such apparatus can further comprise a substantially vertical rod, bar or analogous means for coupling the link which is secured to the first component with the link which is secured to the second component. At least one of the moving means for the first and second components of the receptacle can comprise a cam-and-follower assembly.

The apparatus can further comprise a third transporting unit which serves to advance empty trays from the tray evacuator to the tray filler. Such third transporting unit can define a substantially U-shaped path along which empty trays advance from the tray evacuator to the tray filler.

The first transporting unit can define an at least substantially straight path which can extend from a maker to a processing machine, and the junction is preferably disposed downstream of the diverting means, as considered in the direction of advancement of articles with a first transporting unit.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
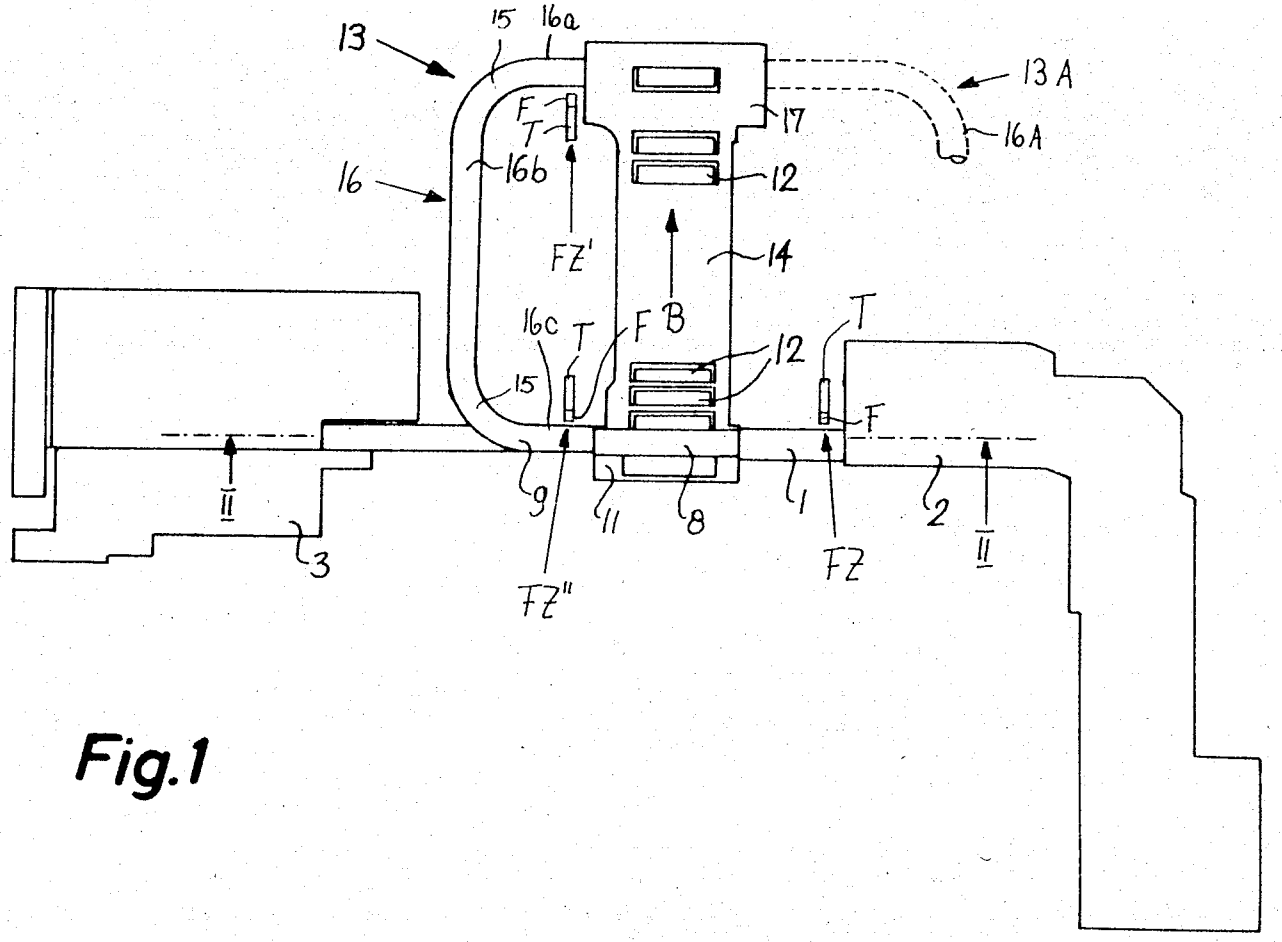
FIG. 1 is a schematic plan view of a transporting apparatus which embodies one form of the invention and wherein the inverting means is incorporated into the second conveying section of the second transporting unit.
Figure 2:
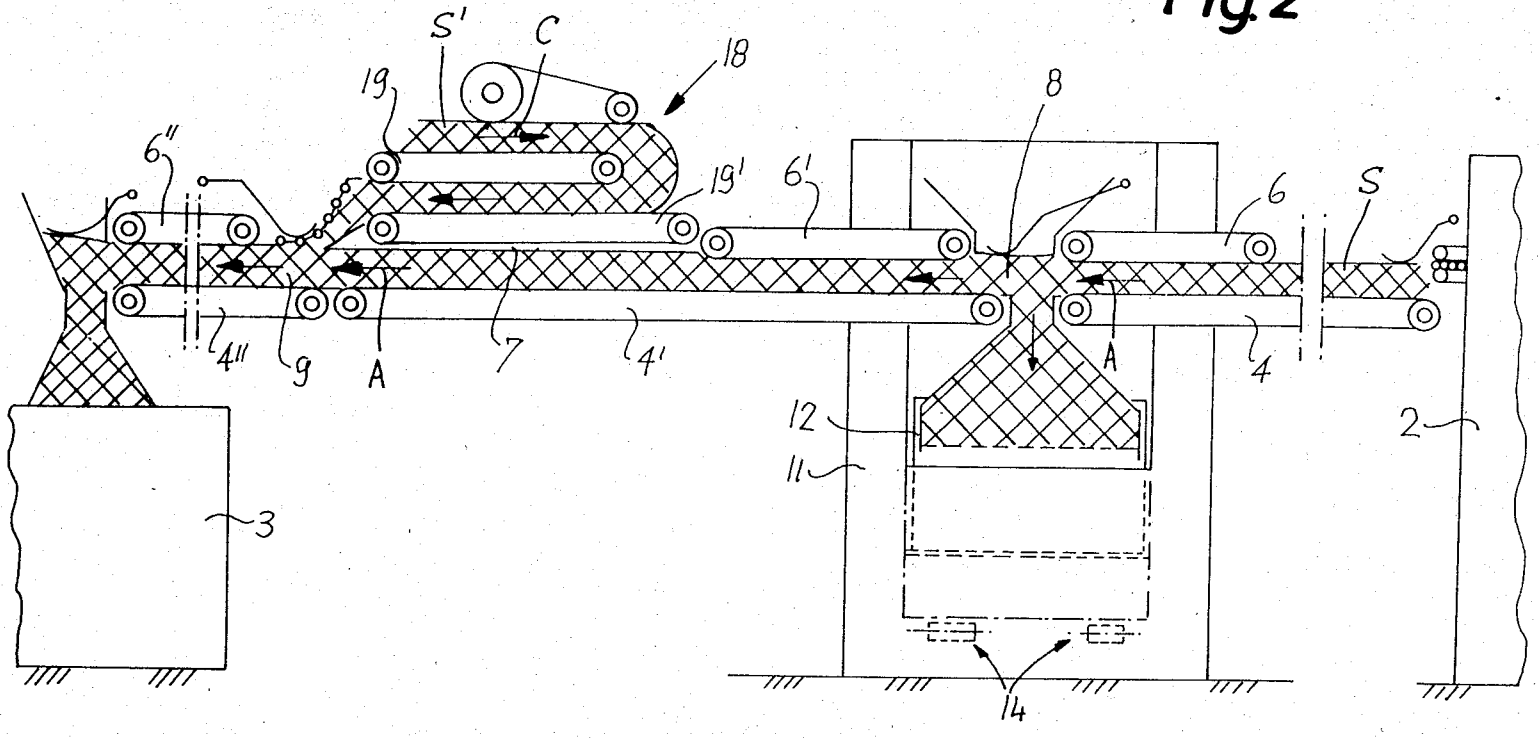
FIG. 2 is an enlarged fragmentary longitudinal vertical sectional view of the first transporting unit in the apparatus of FIG. 1, substantially seen in the direction of arrows from the line II—II.

FIG. 1 is a schematic plan view of a transporting apparatus for rod-shaped articles in the form of filter cigarettes of unit length. The apparatus comprises a straight or substantially straight first transporting unit 1 which advances a multi-layer stream S (see FIG. 2) from a first machine 2 (e.g., a filter tipping machine of the type known as MAX or MAX S manufactured by the assignee of the present application) to a second (processing) machine, e.g., to a packing machine of the type known as COMPAS manufactured by the assignee of the present application. The direction of transport of articles along the straight path which is defined by the first transporting unit 1 is indicated by the arrows A. As can be seen in FIG. 2, the transporting unit 1 comprises a set of aligned lower endless belt conveyors 4, 4' and 4'', and a set of aligned upper endless belt conveyors 6, 6' and 6''. The articles are moved sideways, i.e., their orientation is such that they move at right angles to their respective axes and that all of the filters face in the same direction (note the filter cigarette FZ in FIG. 1; its tobacco-containing portion is shown at T and its filter is shown at F).

The first transporting unit 1 comprises a diverting device 8 which enables the articles to leave the straight path between the lower conveyors 4 and 4' and to enter a tray filler 11, e.g., a tray filler of the type known as HCF manufactured by the assignee of the present application. The diverting device 8 is defined by the neighboring end turns of the conveyors 4 and 4' and can be closed or deactivated when all of the articles are to advance toward and into the packing machine 3. Furthermore, the first transporting unit 1 includes a junction 9 which is located downstream of the diverting device 8 and wherein rod-shaped articles can be admitted into the first transporting unit when the quantity of articles supplied by the filter tipping machine 2 does not suffice to meet the requirements of the packing machine 3. In the embodiment of FIGS. 1 and 2, the junction 9 is disposed in the region where the articles reach the upper stretch of the lower belt conveyor 4". The reference character 7 denotes a cover plate which overlies the stream S of articles between the lower stretches of the upper conveyors 6' and 6". The junction 9 is located between the left-hand end of the cover plate 7 and the conveyor 6".

The apparatus of FIGS. 1 and 2 further comprises a second transporting unit 13 which can be said to constitute a magazine or reservoir for temporary storage of surplus articles and which includes the aforementioned tray filler 11. FIG. 2 shows the tray filler 11 in the process for filling a customary charger or tray 12 with articles which descend between the lower belt conveyors 4 and 4' because the quantity of articles supplied by the filter tipping machine 2 exceeds the requirements of the packing machine 3.

In addition to the tray filler 11, the second transporting unit 13 comprises a first conveying section 14 which can constitute a system of conveyors serving to advance filled trays 12 along a straight path in the direction of arrow B so that the orientation of articles in the filled trays 12 does not change during transport into the range of a tray evacuator 17 which constitutes a further element of the second transporting unit 13 and serves to empty the contents of successively delivered filled trays 12 (i.e., to convert filled trays into empty trays) and to discharge a stream S' of parallel articles which are delivered to the junction 9 by a second conveying section 16 of the second transporting unit. It will be noted that the unit 13 connects the diverting device 8 with the junction 9 so that, when necessary, articles forming the stream S' can be delivered into the path which is defined by the first transporting unit 1 to supplement the stream S when the requirements of the packing machine 3 exceed the output of the filter tipping machine 2.

The tray evacuator 17 may be of the type known as Magomat S which is manufactured by the assignee of the present application. The exact design of the tray evacuator 17 forms no part of the present invention; it suffices to say that this machine comprises or can comprise a rotary head which can pivot or tilt filled trays 12 about axes that are parallel with the longer edges of the filled trays so that the articles which are discharged by the tray evacuator 17 and form the stream S' are oriented in a manner as shown at FZ' in FIG. 1. It will be noted that the articles which issue from the tray evacuator 17 are turned through 180° with reference to the articles in the stream S, i.e., with reference to the articles which are supplied by the filter tipping machine 2.

The first conveying section 14 of the second transporting unit 13 may constitute an automatic coupling system of the type known as TTU/TTUF (manufactured by the assignee of the present application). Two conveyors of this system are shown schematically in the lower portion of FIG. 2 below the tray 12 in the tray filler 11.

In accordance with a feature of the invention, the second conveying section 16 of the second transporting unit 13 comprises or constitutes an article inverting or turn-around or orientation changing device 15 which ensures that the orientation of articles supplied by the tray evacuator 17 is changed again so that the orientation of articles (note the article FZ" in FIG. 1) which are about to enter the junction 9 and form part of the stream S' matches the orientation of articles FZ which are supplied by the filter tipping machine 2. It will be noted that the inverting device 15 causes the articles of the stream S' to advance along an arcuate path and to change their orientation by 180° so that the total change in orientation of articles (FZ) leaving the first transporting unit 1 via diverting device 8 and returning into the first transporting unit 1 at the junction 9 equals 360°.

As can be seen in FIG. 1, the second conveying section 16 of the second transporting unit 13 comprises a first portion 16*a* which is substantially parallel to the first transporting unit 1, a second portion 16*b* which defines a substantially U-shaped path and thereby changes the orientation of articles in the stream S' by 180°, and a third portion 16*c* which is again parallel to the first transporting unit 1 and delivers articles in a direction (note the arrow C in FIG. 2) which is counter to the direction of transport (arrows A) of articles in the first transporting unit 1. Therefore, the second transporting unit 13 further comprises a reversing device 18 which is shown in FIG. 2 and serves to reverse the direction of articles in the stream S' between the second conveying section 16 and the junction 9. The illustrated reversing device 18 comprises two endless belt or band conveyors 19 and 19' defining a substantially U-shaped path the upper leg of which receives articles from the portion 16*c* and the lower leg of which delivers articles to the junction 9. The conveyors 19 and 19' merely change the direction of travel but not the orientation of articles which form the stream S' and approach the junction 9.

The portion 16*b* of the second conveying section 16 of the second transporting unit 13 (i.e., the inverting device 15) can include curve-going conveyors, e.g., conveyors of the type known as Flex-Link (manufactured and sold by the firm Aktiebolag SKF Flex-Ling, S-41550 Göteborg, Sweden).

The change of orientation which is effected by the tray evacuator 17 in the process of evacuating the contents of filled trays 12 is automatically compensated for or supplemented by the inverting device 15 of the second conveying section 16 so that the orientation of articles entering the first transporting unit 1 via junction 9 is invariably the same as that of the articles which are delivered by the filter tipping machine 2. Thus, by the very simple expedient of guiding the stream S' along an arcuate path, the apparatus of FIGS. 1 and 2 ensures that each article entering the packing machine 3 is in an optimum orientation for introduction into packs or other types of containers.

An important advantage of the apparatus which is shown in FIGS. 1 and 2 is that the positioning of the tray filler 11 and tray evacuator 17 with reference to each other need not depart from the customary positioning of such machines in heretofore known production lines. Also, the first conveying section 14 may be of commercially available design. All that is necessary to ensure that the orientation of articles (FZ") which are caused to reenter the first transporting unit 1 at the junction 9 is the same orientation in which such articles were caused by leave the unit 1 via diverting device 8 is to provide the second conveying section 16 with a loop-forming inverting device 15 which completes the job of the tray evacuator 17, i.e., which complements the orientation-changing operation of the machine 17 so that the final orientation of articles reaching the reversing device 18 and thence the junction 9 is the same as the orientation of articles which reach the junction 9 by advancing along the path that is defined by the first transporting unit 1 and extends from the diverting device 8 directly to and beyond the junction 9.

The fact that, on its way to the junction 9, the article stream S' must pass through the reversing device 18 is of no consequence since many presently known reversing devices can treat, very gently, large quantities of highly sensitive articles such as plain or filter tipped cigarettes or the like.

The apparatus of FIGS. 1 and 2 can be modified in a number of ways without departing from the spirit of the invention. For example, and as shown schematically in FIG. 1 by broken lines (at 13A), the second section (16A) of the second transporting unit can be located to the right of the first conveying section 14, i.e., nearer to the filter tipping machine 2. In such modified transporting apparatus, the junction of the first transporting unit is disposed upstream of the diverting device so that the articles which are admitted from the second into the first transporting unit advance through the diverting device twice, namely, first during admission into trays 12 and again subsequent to reentry into the first transporting unit 1.

Figure 3:
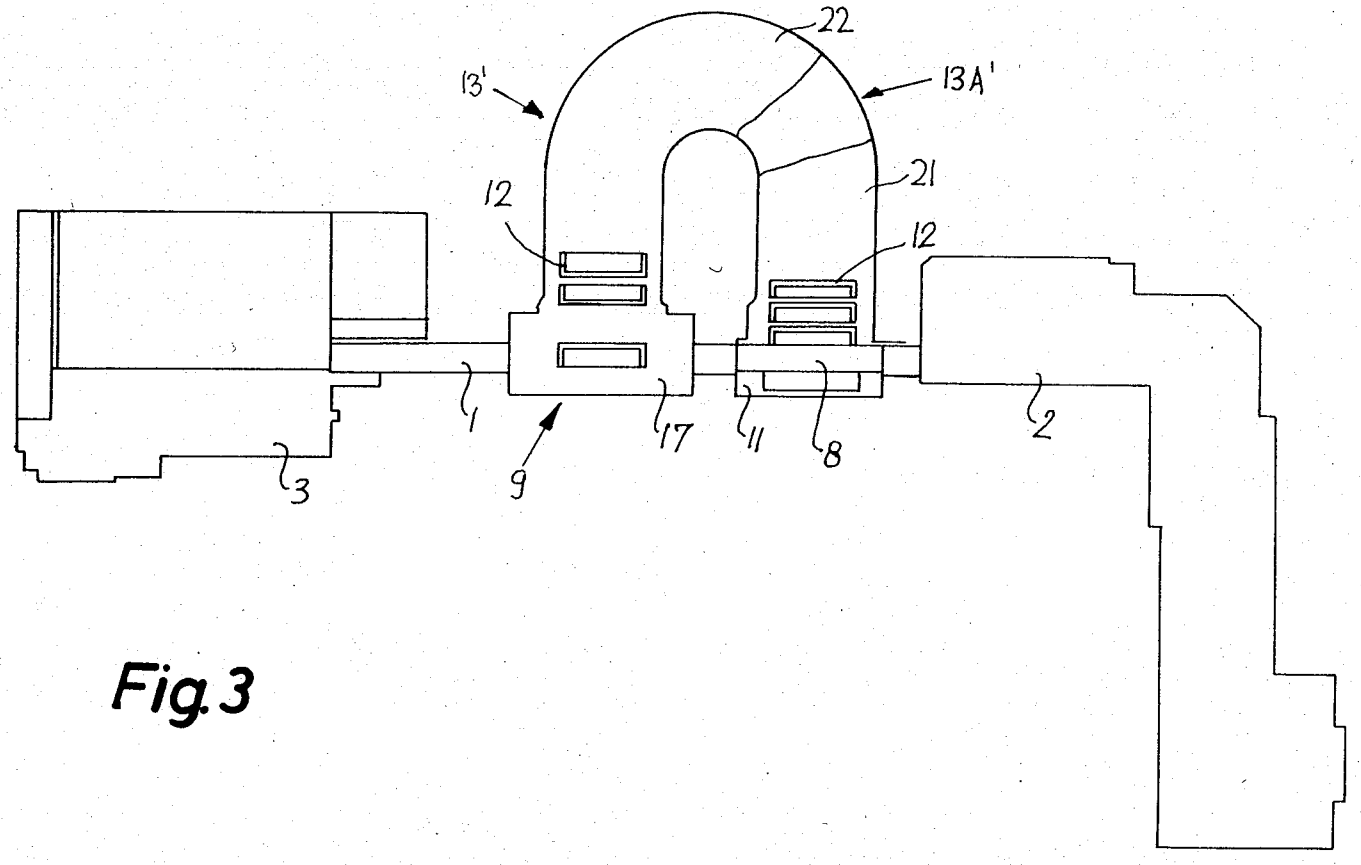
FIG. 3 is a schematic plan view of a second transporting apparatus wherein the inverting means is incorporated into the first conveying section of the second transporting unit.

FIG. 3 illustrates a modified transporting apparatus wherein all such parts which are identical with or clearly analogous to corresponding parts of the apparatus of FIGS. 1 and 2 are denoted by similar reference characters. The manner in which the first transporting unit 1 advances rod-shaped articles (e.g., filter cigarettes FZ) from a first machine 2 (such as a filter tipping machine) to a second machine 3 (such as a packing machine) is the same or substantially the same as described in connection with FIGS. 1 and 2. The main difference between the transporting apparatus of FIGS. 1–2 on the one hand and the transporting apparatus of FIG. 3 on the other hand is that the inverting or orientation changing device 22 forms part of the first conveying section 21 of the second transporting unit 13', i.e., a first change in orientation of rod-shaped articles takes place before they reach the tray evacuator 17. The tray filler 11 (which can be identical with the tray filler of FIGS. 1–2), the first transporting unit 1, and the tray evacuator 17 (which can be identical with the tray evacuator of FIGS. 1–2) are disposed in a common vertical plane. The tray filler 11 is disposed at a level below and the tray evacuator 17 is disposed at a level above the transporting unit 1.

The inverting device 22 of the first conveying section 21 of the second transporting unit 13' defines a substantially U-shaped path along which filled trays 12 leaving the tray filler 11 are caused to advance on their way toward the tray evacuator 17. Thus, the orientation of articles which leave the first transporting unit 1 via diverting device 8 and enter successive trays 12 in the tray filler 11 remains unchanged. However, the orientation of such articles is changed by 180° during transport along the path which is defined by the conveying section 21, and the orientation of the articles is changed again (by 180°) during conversion of the contents of successive filled trays 12 into a stream, such as the stream S' shown in FIG. 2. Therefore, the orientation of articles which enter the second conveying section (not shown) of the second transporting unit 13' is the same as that of articles which do not leave the first transporting unit 1 via diverting device 8 but continue to move on toward the packing machine 3. At least a portion of the path along which filled trays 12 advance in the first conveying section 21 of the transporting unit 13' is preferably located in a horizontal plane. The second conveying section of the second transporting unit 13' may but need not always comprise a reversing device, such as the device 18 shown in FIG. 2. The first conveying section 21 of the second transporting unit 13' can utilize one or more curve-going conveyors, e.g., the aforediscussed Flex-Link conveyors which define the arcuate portions of the path wherein filled trays 12 advance from the tray filler 11 to the tray evacuator 17 of FIG. 3.

The apparatus of FIG. 3 preferably further comprises a third transporting unit 13A' which serves to deliver empty trays 12 from the tray evacuator 17 to the tray filler 11 on demand. The third transporting unit 13A' is preferably disposed at a level above or below the transporting unit 13'. For example, that conveying section of the third transporting unit 13A' which corresponds to the conveying section 21 of the second transporting unit 13' can be installed in a horizontal plane which is disposed below and is parallel to the preferably horizontal plane of the conveying section 21 shown in FIG. 3.

Figure 4:
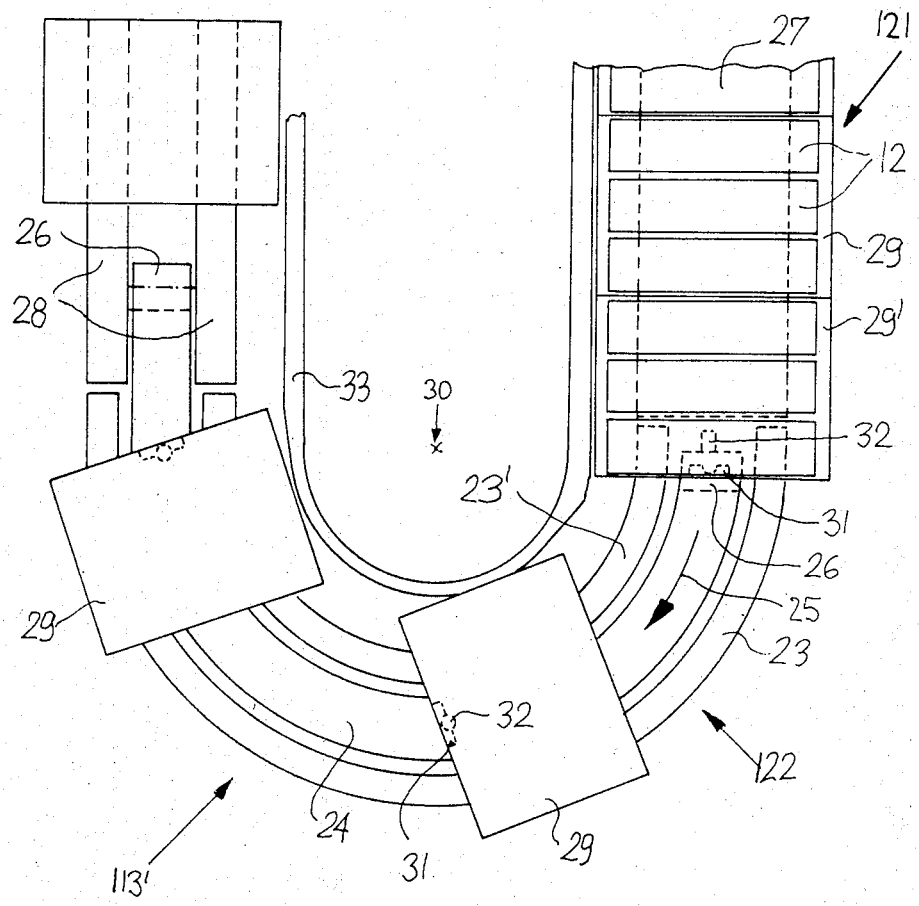
FIG. 4 is a larger-scale schematic plan view of a first conveying section which can be utilized in the transporting apparatus of FIG. 3.

A portion of a modified first conveying section 121 for use in the second transporting unit 113' of a transporting apparatus corresponding to that of FIG. 3 is illustrated in FIG. 4. The conveying section 121 constitutes or includes a looped inverting or orientation changing device 122 which comprises two arcuate rails 23 and 23' disposed in a horizontal plane and extending along arcs of 180° between a first conveyor 27 which follows the tray filler (not shown) and a second conveyor 28 that precedes the tray evacuator (not shown). The tray filler and the tray evacuator which form part of the second transporting unit 113' shown in FIG. 4 may be identical with the aforediscussed machines 11 and 17.

The rails 23 and 23' flank an endless flexible element 24 which is a belt conveyor trained over a set of pulleys or rolls 26. The structure of FIG. 4 further comprises a set of tray carriers 29 in the form of pallets or platforms each of which can support two or more filled trays 12. The flexible element 24 and the pallets 29 can be said to constitute a curve-going conveyor for groups of filled trays 12. The conveyor 27 is designed to move loaded pallets 29 (each of which can support, for example, three filled trays 12) in the direction of arrow 25, and the conveyor 24 has spaced-apart first entraining elements 32 engageable with complementary entraining elements 31 on the pallets 29 to transport successive loaded pallets along an arc of 180° and to deliver successive loaded pallets into the range of the conveyor 28. The latter then transports such loaded pallets to the tray evacuator. The entraining elements 31 are preferably disposed at the undersides of the pallets 29 and cooperate with the adjacent entraining elements 32 to separably couple the loaded pallets to the conveyor 24 during travel along the arcuate path which is defined by this conveyor and the rails 23, 23' of the inverting device 122. A further rail 33 is provided to guide the pallets 29 during travel between the conveyors 27 and 28; the pallets then travel along a preferably horizontal path about a vertical axis 30.

The conveyor 27 preferably advances loaded pallets 29 in stepwise fashion, namely, at the rate at which the tray filler converts successive empty trays into filled trays. Pallets 29 with groups of filled trays 12 thereon advance downwardly, as viewed in FIG. 4. When the foremost loaded pallet 29' reaches the discharge end of the conveyor 27, its entraining element 31 is in a position to be engaged by the oncoming entraining element 32 of the conveyor 24 so that the latter removes the foremost pallet 29' from the conveyor 27 and begins to advance such pallet along the rails 23, 23' and 33 toward the receiving end of the conveyor 28 where its entraining element 32 is automatically detached from the entraining element or elements 31 of the loaded pallet 29' so that the latter can be taken over by the conveyor 28 which delivers it into the range of the tray evacuator. In other words, the extent of overlap between the path portions which are defined by the conveyors 24 and 28 suffices to ensure that successive loaded pallets 29 are reliably accepted and advanced by the conveyor 28.

The apparatus which includes the second transporting unit 113' of FIG. 4 preferably further comprises a third transporting unit which can constitute a mirror image of the transporting unit 113' and serves to deliver pallets 29 with empty trays 12 thereon back to the tray filler, i.e., to a location upstream of the conveyor 27, as considered in the direction of arrow 25. The third transporting unit can be installed in the plane of the second transporting unit 113'. As viewed in FIG. 4, such third transporting unit is located at a level above the illustrated second transporting unit 113'.

Figure 5:
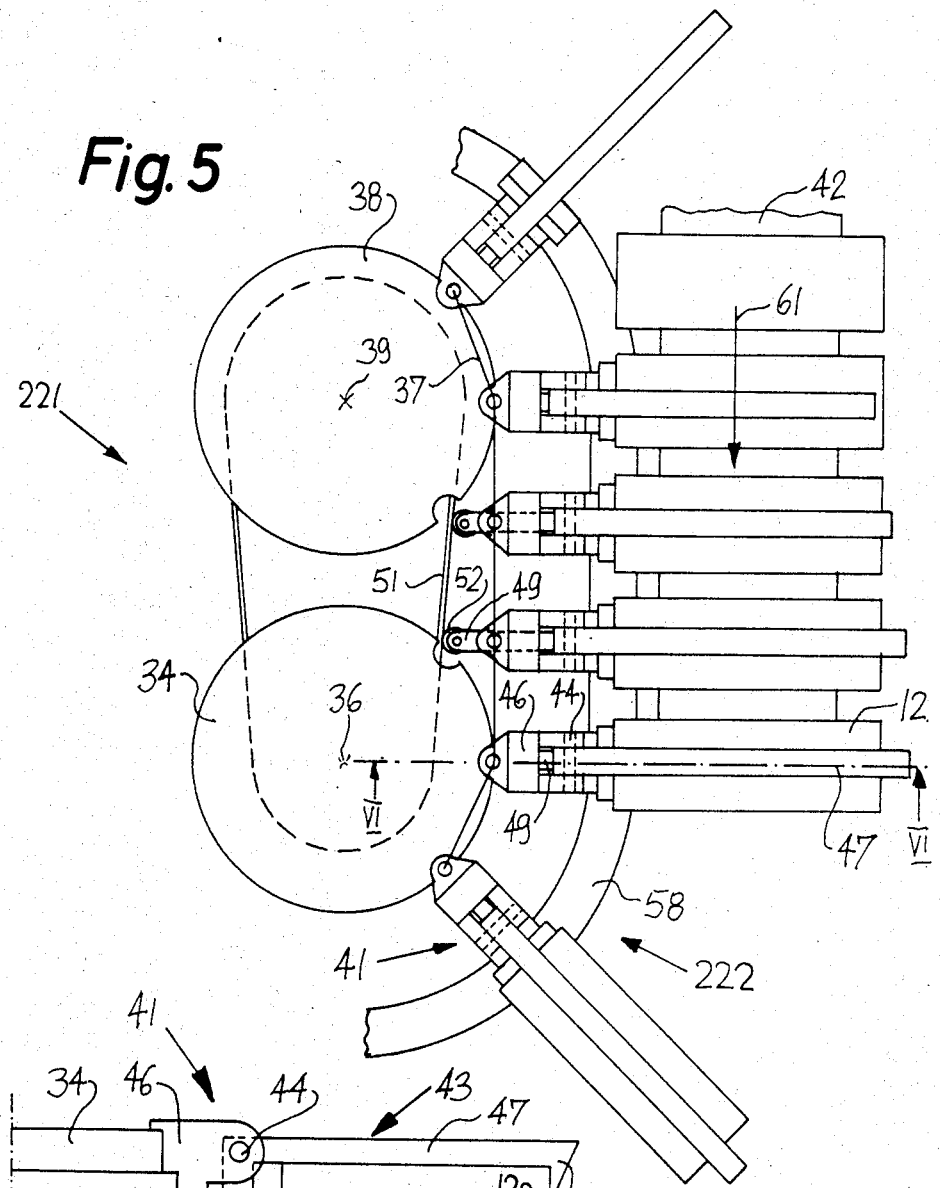
FIG. 5 is a fragmentary plan view of a modified first conveying section.
Figure 6:
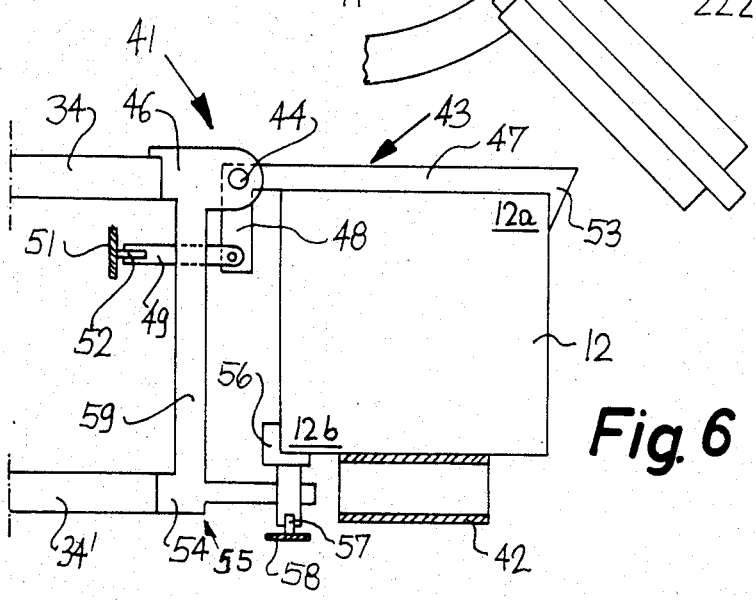
FIG. 6 is a vertical sectional view as seen in the direction of arrows from the line VI—VI of FIG. 5.

Referring finally, to FIGS. 5 and 6, there is shown a further inverting or orientation changing device 222 which can be utilized in lieu of the inverting device 22 or 122, i.e., which can form part of or which can constitute the first conveying section in the second transporting unit of the improved transporting apparatus. This inverting device comprises two pairs of sprocket wheels including a first pair of sprocket wheels 34, 34' which are driven to rotate about a first vertical axis 36 and a second pair of sprocket wheels (only the upper sprocket wheel 38 is shown in FIG. 5) which are driven to rotate about a second vertical axis 39. The upper sprocket wheels (34, 38) are located in a first horizontal plane and the lower sprocket wheels (including the sprocket wheel 34') are disposed in a second horizontal plane at a level below the first horizontal plane. A first endless link chain 37 is trained over the upper sprocket wheels 34, 38, and a second endless link chain 55 is trained over the lower sprocket wheels.

The inverting device 222 further comprises a set of receptacles 41 which serve to engage and transport successive filled trays 12 from the tray filler (not shown in FIGS. 5 and 6) to the tray evacuator (not shown). Each receptacle 41 comprises a yoke-like upper or first component 43 which is secured to a link 46 of the upper chain 37 and a second or lower component 56 which is secured to a link 54 of the lower chain 55. The receptacles 41 are equidistant from one another and receive filled trays 12 from a conveyor 42 which corresponds to the conveyor 27 of FIG. 4 and receives filled trays from the tray filler. The direction in which the conveyor 42 and the receptacles 41 advance successive filled trays 12 is indicated by the arrow 61.

The components 43 of the receptacles 41 resemble bell crank levers which are pivotable about the axes of horizontal pins 44 mounted on the corresponding links 46 of the upper chain 37. The longer upper arms 47 of the components 43 overlie the respective filled trays 12 and each thereof includes a tooth-like end portion 53 resembling a pawl and serving to engage the upper right-hand corner 12*a* of the filled tray 12 shown in FIG. 6. The shorter lower arm 48 of each bell crank lever or component 43 is articulately connected with a link or post 49 carrying a roller follower 52 which tracks the face of a stationary cam 51 serving to pivot the component 43 during certain stages of movement of the respective receptacle 41 along the path which is defined by the chains 37 and 55. The arrangement is such that the pawl 53 of the longer arm 47 of a component 43 which approaches the conveyor 42 is lifted above the upper end of the oncoming filled tray 12 but the cam 51 thereupon causes or allows the component 43 to pivot clockwise, as viewed in FIG. 6 (to the position shown in FIG. 6), and to thereby engage the adjacent filled tray 12 from above. At the same time or thereafter, a further cam 58 causes the roller follower 57 on the lower component 56 of the respective receptacle 41 to engage the lower left-hand corner 12*b* of the filled tray 12 from below so that the filled tray is securely held during transport around the sprocket wheels 34, 34' and on toward a conveyor (corresponding to the conveyor 28) which accepts filled trays from successive receptacles 41 and delivers them into the range of the tray evacuator.

The lower components 56 of the receptacles 41 are movable up and down with reference to the corresponding chain links 54 and serve primarily to support the filled trays from below as well as from one side, namely, the left-hand side of the tray 12 shown in FIG. 6.

Those links 46 of the upper chain 37 which are secured to upper components 43 are preferably rigidly connected with the corresponding chain links 54 (namely, with the chain links which carry the lower components 56 of the respective receptacles 41) by vertical coupling rods or bars 59. This enhances the stability of the conveyor system which transports the receptacles 41 between the conveyor 42 and the conveyor preceding the tray evacuator.

The operation of the inverting device 222 is as follows:

The movements of the chains 37 and 55 are synchronized with the movements of filled trays 12 on the conveyor 42 (which receives such trays from the tray filler) so that each oncoming receptacle 41 can engage and securely hold the adjacent filled tray 12 before the filled tray leaves the conveyor 42. The upper component 43 of a receptacle 41 which is about to receive a filled tray 12 is lifted above the respective tray by the cam 51, and the lower component 56 of such receptacle is lowered below the respective tray 12 before the tray is ready to be removed from the conveyor 42. The components 43 and 56 of a receptacle 41 assume the just discussed (raised and lowered) positions during travel around the sprocket wheels including the sprocket wheel 38 of FIG. 5, i.e., during travel about the vertical axis 39. The cam 51 thereupon causes gradual lowering (clockwise pivoting, as viewed in FIG. 6) of the upper component 43 toward the position which is shown in FIG. 6, and the lowering of the component 43 is completed not later than when such component reaches the line VI–VI of FIG. 5. Thus, the arm 47 then overlies the upper side of the filled tray 12 and the pallet or tooth of the pawl 53 engages the corner 12*a* of such tray. Not later than at such time, the lower component 56 of the same receptacle 41 reaches the position of FIG. 6 in which it supports the corner 12*b* of the tray 12 from below as well as from one side. Thus, the tray 12 of FIG. 6 is held at two corners which are disposed diagonally opposite each other, and this invariably ensures that the tray can remain in requisite engagement with the corresponding receptacle 41 during transport along the arcuate path around the axis 36 and toward the tray evacuator. It can be said that the filled tray 12 which is held by a receptacle 41 actually floats or is freely suspended on the chains 37 and 55 while it moves about the pair of sprocket wheels 34, 34' toward the conveyor preceding the tray evacuator. When the filled tray 12 is in the range of such conveyor, the aforedescribed procedure is repeated but in reverse order, i.e., the components 43 and 56 of the corresponding receptacle 41 are respectively lifted above and lowered below the tray so that the latter can come to rest on the conveyor which delivers it into the range of the tray evacuator.

The structure of FIGS. 5 and 6 exhibits the advantage that the filled trays 12 can be engaged and transported individually rather than in groups of two or more. Each filled tray is turned around through an angle of 180° so that such change of orientation of the articles therein is then followed by a further change of orientation during evacuation of the contents of the filled tray with the result that the articles which are returned to the first transporting unit are oriented in the same way as the articles which did not leave the first transporting unit on their way from a first to a second machine, such as the machines 2 and 3 of FIG. 1.

The apparatus which are illustrated in FIGS. 3 to 6 exhibit the advantage that the articles are partially reoriented while they are confined in the filled trays 12 so that the likelihood of damage to articles during such partial change of orientation (in the first conveying section 21, 121 or 221) is very remote. Furthermore, the apparatus which is shown in FIGS. 5 and 6 has been found to treat the articles very gently because each and every tray 12 is individually engaged and transported by a separate receptacle 41 engaging the tray at two corners which are disposed diametrically opposite each other so that the condition of the array of articles in the filled trays 12 moving with the receptacles 41 does not change at all. This is believed to be attributable to the provision of endless chains 37, 55 or analogous conveying elements which are caused to circulate in two superimposed parallel planes. The cam-and-follower assemblies 51, 52 and 57, 58 also contribute to reliable guidance of receptacles 41 and filled trays 12 therein from the conveyor 42 to the conveyor which precedes the tray evacuator.

All embodiments of the improved apparatus exhibit the advantage that their operation can be fully automated with a minimum of outlay for controls. This is due to the fact that the second transporting unit comprises two orientation changing means, namely, the tray evacuator 17 and the loop-forming inverting device which is incorporated into the first or into the second conveying section of the second transporting unit. This ensures that the orientation of all articles which advance in the first transporting unit beyond the diverting device or beyond the junction (whichever is nearer to the receiving or consuming machine 3) is always the same.

Another important advantage of the improved apparatus is that the means for completing or supplementing the changes in orientation which are caused by the tray evacuator 17 or an analogous tray evacuator are extremely simple, compact and inexpensive. Thus, all that is necessary is to provide an inverting device which can guide the stream S' or the filled trays 12 along an arcuate path of 180° to thus complete or precede the changes of orientation which are brought about by the tray evacuator 17. As mentioned above, the second transporting unit of the improved transporting apparatus can treat the articles gently so that the quality of articles which reenter the first transporting unit need not be inferior, in any respect, to the quality of articles which remain in the first transporting unit during their travel from the machine 2 to the machine 3.

A further important advantage of the improved apparatus is that, if necessary, it can fill trays 12 for use in other types of apparatus when the output of the machine 2 exceeds the requirements of the processing machine 3 for long or very long intervals of time. By the same token, and since the tray filler 11 and the tray evacuator 17 may constitute commercially available machines utilizing conventional chargers or trays, the tray evacuator 17 in the apparatus of the present invention can receive filled trays from sources other than the tray filler 11, i.e., from other production lines, when the requirements of the machine 3 exceed the output of the machine 2 for extended or very long intervals of time.

A tray evacuator which can be utilized in the transporting apparatus of the present application is disclosed, for example, in U.S. Pat. No. 3,777,911 granted Dec. 11, 1973 to Ulrich Bornfleth and in U.S. Pat. No. 4,278,385 granted July 14, 1981 to Bardenhagen et al. A tray filler which can be utilized in the transporting apparatus of the present application is disclosed, for example, in U.S. Pat. No. 4,207,720 granted June 17, 1980 to Tolasch et al. and in U.S. Application Ser. No. 06/232 252 filed on 02/06/81 by Rolf Gömann et al. Section 14 of the transporting unit 13 shown in FIG. 1 is disclosed, for example, in afore said U.S. Pat. No. 3,777,911.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for manipulating rod-shaped articles which constitute or form part of smokers' products, comprising a first transporting unit arranged to advance a stream of articles in a predetermined direction and in a predetermined orientation and including at least one article diverting means and at least one junction; and a second transporting unit including a tray filler arranged to admit articles which are diverted by said diverting means into empty trays while said predetermined orientation of articles remains unchanged to thus convert such trays into filled trays, a tray evacuator arranged to remove articles from filled trays and to convert the removed articles into a second stream with attendant first change in orientation of articles, first conveying means arranged to deliver filled trays to said evacutor, and second conveying means arranged to deliver the second stream of said junction and including orientation changing means for further changing the orientation of diverted articles in addition to the change in orientation which is effected by said evacuator so that the combined change in orientation restores said predetermined orientation of diverted articles not later than in said junction, said orientation changing means including a portion extending in a substantially horizontal plane along an arc with reference to said first transporting unit.

2. The apparatus of claim 1, wherein said portion of said orientation changing means extends along an arc of 180°.

3. The apparatus of claim 1, wherein said second conveying means includes a first portion receiving the stream from said evacuator and being substantially parallel to said first transporting unit, an arcuate second portion which constitutes said portion of said orientation changing means and receives the stream from said first portion, and a third portion which is at least substantially parallel to said first unit, which receives the stream from said second portion, and which advances the articles of the stream toward said junction in a direction counter to said predetermined direction.

4. The apparatus of claim 3, wherein said second conveying means further comprises means for reversing the direction of advancement of articles between said third portion and said junction.

5. The apparatus of claim 1, wherein said portion of said orientation changing means forms part of said first conveying section.

6. The apparatus of claim 5, wherein said portion of said orientation changing means extends along an arc of 180°g.

7. The apparatus of claim 5, wherein said first transporting unit, said tray filler and said tray evacuator are disposed in a common vertical plane and said portion of said orientation changing means constitutes a substantially U-shaped loop disposed between said tray filler and said tray evacuator.

8. The apparatus of claim 1, further comprising a third transporting unit arranged to advance empty trays from said tray evacuator to said tray filler.

9. The apparatus of claim 8, wherein said third transporting unit defines a substantially U-shaped path along which empty trays advance from said tray evacuator to said tray filler.

10. The apparatus of claim 1, wherein said portion of said orientation changing means forms part of said first conveying section and includes a curve-going conveyor.

11. The apparatus of claim 10, wherein said curve-going conveyor includes a plurality of carriers each arranged to accept and to advance a plurality of filled trays from said tray filler toward said tray evacuator and means for advancing said carriers along an arcuate path.

12. The apparatus of claim 11, wherein said path is a substantially semicircular path and said advancing means comprises an elongated driven conveying element defining said path and having spaced-apart first entraining elements separably engageable with complement or second entraining elements provided on said carriers.

13. The apparatus of claim 12, wherein said conveying element is disposed in a substantially horizontal plane and is arranged to advance the carriers about a substantially vertical axis so that the orientation of carriers with reference to said axis remains at least substantially unchanged.

14. The apparatus of claim 10, wherein said curvego-ing conveyor comprises at least one receptacle for filled trays and means for advancing said receptacle along an arcuate path about a substantially vertical axis.

15. The apparatus of claim 14, wherein said advancing means comprises a conveying element which is disposed in a substantially horizontal plane.

16. The apparatus of claim 15, wherein said conveying element includes at least one endless chain adjacent to said arcuate path.

17. The apparatus of claim 14, wherein said receptacle comprises first and second components, means for moving said first component into engagement with a filled tray from above, and means for moving said second component into engagement with such filled tray from below.

18. The apparatus of claim 17, wherein each filled tray has upper and lower corner portions disposed substantially diagonally opposite each other and being respectively engageable by the first and second components of said receptacle.

19. The apparatus of claim 17, wherein said first component includes a yoke and the means for moving said first component includes means for pivoting said yoke between a raised position of disengagement from a lowered position of engagement with a filled tray.

20. The apparatus of claim 17, wherein said advancing means comprises first and second endless flexible elements respectively disposed in upper and lower horizontal planes, said first and second components being respectively secured to said first and second flexible elements.

21. The apparatus of claim 20, wherein said flexible elements are link chains and said components are secured to the links of the respective chains.

22. The apparatus of claim 21, further comprising means for coupling the link which is secured to said first component with the link which is secured to said second component.

23. The apparatus of claim 22, wherein said coupling means comprises a substantially vertical rod.

24. The apparatus of claim 17, wherein at least one of said moving means includes a cam-and-follower assembly.

25. The apparatus of claim 1, wherein said first transporting unit defines an at least substantially straight path and said junction is disposed downstream of said diverting means, as considered in said direction.

26. Apparatus for manipulating rod-shaped articles which constitute or form part of smoker's products, comprising a first transporting unit arranged to advance a stream of articles in a predetermined direction and in a predetermined orientation and including at least one article diverting means and at least one junction; and a second transporting unit including a tray filler arranged to admit articles which are diverted by said diverting means into empty trays while said predetermined orientation of articles remains unchanged to thus convert such trays into filled trays, a tray evacuator arranged to remove articles from filled trays with attendant change in orientation of articles and to convert the removed articles into a second stream for delivery to said junction, and conveying means arranged to deliver filled trays to said evacuator and including orientation changing means for changing the orientation of articles with the respective filled trays ahead of said evacuator so that the combined change in orientation of articles by said orientation changing means and said evacuator restores said predetermined orientation of diverted articles not later than in said junction, said orientation changing means including a portion extending in a substantially horizontal plane along an arc with reference to said first transporting unit.

27. The apparatus of claim 26, wherein said orientation changing means extends along an arc of 180°.

28. The apparatus of claim 26, wherein said first transporting unit, said tray filler and said tray evacutor are disposed in a common vertical plane and said portion of said orientation changing means constitutes a substantially U-shaped loop disposed between said tray filler and said tray evacuator.

29. The apparatus of claim 26, further comprising a third transporting unit arranged to advanced empty trays from said tray evacuator to said tray filler.

30. The apparatus of claim 29, wherein said third transporting unit defines a substantially U-shaped path along which empty trays advance from said tray evacuator to said tray filler.

31. The apparatus of claim 26, wherein said orientation changing means includes a curve-going conveyor.

32. The apparatus of claim 31, wherein said curve-going conveyor includes a plurality of carriers each arranged to accept and to advance a plurality of filled trays from said tray filler toward said tray evacuator and means for advancing said carriers along an arcuate path.

33. The apparatus of claim 32, wherein said path is a substantially semicircular path and said advancing means comprises an elongated driven conveying element defining said path and having spaced-apart first entraining elements separably engageable with complementary second entraining elements provided on said carriers.

34. The apparatus of claim 33, wherein said conveying element is disposed in a substantially horizontal plane and is arranged to advance the carriers about a substantially vertical axis so that the orientation of carriers with reference to said axis remains at least substantially unchanged.

35. The apparatus of claim 31, wherein said curve-going conveyor comprises at least one receptacle for filled trays and means for advancing said receptacle along an arcuate path about a substantially vertical axis.

36. The apparatus of claim 35, wherein said advancing means comprises a conveying element which is disposed in a substantially horizontal plane.

37. The apparatus of claim 36, wherein said conveying element includes at least one endless chain adjacent to said arcuate path.

38. The apparatus of claim 35, wherein said receptacle comprises first and second components, means for moving said first component into engagement with a filled tray from above, and means for moving said second component into engagement with such filled tray from below.

39. The apparatus of claim 38, wherein each filled tray has upper and lower corner portions disposed substantially diagonally opposite each other and being respectively engageable by the first and second components of said receptacle.

40. The apparatus of claim 38, wherein said first component includes a yoke and the means for moving said first component includes means for pivoting said yoke between a raised position of disengagement from and a lowered position of engagement with a filled tray.

41. The apparatus of claim 38, wherein said advancing means comprises first and second endless flexible elements respectively disposed in upper and lower horizontal planes, said first and second components being respectively secured to said first and second flexible elements.

42. The apparatus of claim 41, wherein said flexible elements are link chains and said components are secured to the links of the respective chains.

43. The apparatus of claim 42, further comprising means for coupling the link which is secured to said first component with the link which is secured to said second component.

44. The apparatus of claim 43, wherein said coupling means comprises a substantially vertical rod.

45. The apparatus of claim 38, wherein at least one of said moving means includes a cam-and-follower assembly.

46. Apparatus for manipulating rod-shaped articles which constitute or form part of smokers' product, comprising a tray filler arranged to admit articles into empty trays and to thus convert empty trays into filled trays; means for supplying to said tray filler a first stream of articles in a predetermined orientation; a tray evacuator arranged to remove articles from filled trays and to convert the removed articles into a second stream; and means for conveying filled trays from said tray filler to said tray evacuator including orientation changing means for changing the orientation of articles with the respective filled trays not later than upon delivery of filled trays to said tray evacuator.

47. The apparatus of claim 46, wherein said tray evacuator includes means for changing the orientation of articles in addition to that change which is effected by said orientation changing means.

48. The apparatus of claim 46, wherein said orientation changing means includes a portion extending in a substantially horizontal plane along an arc with reference to said supplying means.

49. The apparatus of claim 46, wherein said orientation changing means includes means for advancing filled trays along an arcuate path having a center of curvature outside of the filled trays in such path.

* * * * *